US007452040B1

(12) United States Patent
Burgess, III

(10) Patent No.: US 7,452,040 B1
(45) Date of Patent: Nov. 18, 2008

(54) GUIDING RAIL FOR A CABINET PULL-OUT PART

(75) Inventor: Thomas Edward Burgess, III, Clarksville, GA (US)

(73) Assignee: Paul Hettich GmbH & Co KG, Kirchlengern (DE)

( * ) Notice: Subject to any disclaimer, the term of this patent is extended or adjusted under 35 U.S.C. 154(b) by 66 days.

(21) Appl. No.: 11/745,217

(22) Filed: May 7, 2007

(51) Int. Cl.
*A47B 88/04* (2006.01)

(52) U.S. Cl. ..... 312/333; 312/319.1; 312/334.8

(58) Field of Classification Search ..... 312/330.1, 312/333, 334.1, 334.7, 334.8, 334.44, 334.47, 312/319.1, 319.2; 384/20, 21
See application file for complete search history.

(56) References Cited

U.S. PATENT DOCUMENTS 4,749,242 A * 6/1988 Rechberg ..... 312/333
4,915,437 A * 4/1990 Cherry ..... 296/37.6
5,033,805 A * 7/1991 Hobbs ..... 312/334.11
2005/0193784 A1 * 9/2005 Sanders ..... 70/106

* cited by examiner

*Primary Examiner*—James O Hansen
(74) *Attorney, Agent, or Firm*—Barnes & Thornburg LLP

(57) ABSTRACT

A guiding rail is described with a carcass rail, fixable to a cabinet carcass, a running rail, fixable to the cabinet pull-out part, a center rail slidably connecting the carcass rail to the running rail, permitting telescopic movement of the carcass rail, the center rail, and the running rail with respect to one another from a compressed position to an extended position, a blocking device, and an operating lug disposed in a rearward end of the running rail. The blocking device includes a rod, at least one first snap-in tooth projecting from the rod, a notch lever pivotally disposed at a rearward end of the center rail, and at least one second snap-in tooth associated with the notch lever. The first and second snap-in teeth engage associated components of the guiding rail such that the guiding rail is lockable in both the extended and compressed positions.

6 Claims, 9 Drawing Sheets

GUIDING RAIL FOR A CABINET PULL-OUT PART

CROSS-REFERENCE TO RELATED APPLICATIONS

This application is a first-filed application and, therefore, does not rely on any other application for priority.

BACKGROUND

1. Field of the Invention

The present invention relates to a guiding rail for a cabinet pull-out part, such as a drawer. More specifically, the present invention relates to a cabinet pull-out part with a carcass rail, which can be fixed to a cabinet carcass, a running rail, which can be fixed to the drawer part, and a pull-out, extending, center rail arranged between the carcass rail and the running rail. Even more specifically, the present invention relates to a cabinet pull-out part including a blocking device where the guiding rail can be mechanically locked in the completely pushed-together state as well as in the fully extended state.

2. Related Art

Guiding rails are known per se.

Particularly, when such guiding rails are used in the case of heavy drawer parts and/or when corresponding guiding rails are used under conditions in which a horizontal orientation of the guiding rails is not always guaranteed, for example, in airplanes, ships, travel buses or the like, it is required for safety-related reasons to equip such guiding rails with blocking devices. These blocking devices provide that, in the closed state, as well as in a completely open state, the drawer parts are secured against an unintended displacement, so that the risk of an unintended opening as well as an unintended closing as a result of the force of gravity is virtually avoided.

In the case of the known guiding rails of this type, the blocking devices are designed such that they respond to the exercising of force in the displacement direction of the individual components of the guiding rail. This means that, when a corresponding drawer is opened, an increased expenditure of force is first required in order to overcome the blocking of the closed position. Likewise, from the opened and blocked position, an increased expenditure of force is first necessary for eliminating this blocking and for being able to displace the drawer into its closed position.

However, particularly when the drawer is fully open, in the case of previous constructions, the blocking device may also be released by an unintended pushing against the drawer part.

A need exists, therefore, for guiding rails for drawers that provide securement against unintended opening or closing as a result of the force or gravity or as a result of unintended pulling on or pushing against the drawer part.

SUMMARY OF THE INVENTION

It is an aspect of the present invention, therefore, to address at least some of the above-noted needs with respect to guiding rails and drawers.

As a result, it is one aspect of the present invention to provide a guiding rail of the above-mentioned type where a blocking device can be unlocked in both displacement directions without any significant expenditure of force and without the risk that the blocking device can be triggered by involuntary or faulty operations.

According to the invention, this aspect can be achieved by providing a blocking device that includes a rod which extends in the longitudinal direction of the running rail, is disposed in this running rail, can be rotated about its longitudinal axis, and has at least one snap-in tooth projecting transversely to the longitudinal axis. The blocking device is further provided with a spring-loaded notch lever swivellably disposed at a rearward end of the center rail, which engages when the guiding rail is completely pushed together. The at least one snap-in tooth engages in a corresponding opening of the carcass rail and, when the guiding rail is completely pulled out, rests against the forward face of the center rail. The rod is spring-loaded such that the at least one snap-in tooth is constantly loaded in the direction of the carcass rail and, when the guiding rail is fully pulled-out, the notch lever engages with at least one snap-in projection in a blocking manner in a recess of the carcass rail and is movable out of the blocking position by a lug fastened to the rearward end of the running rail.

A guiding rail conceived in this manner is blocked by form-locking interacting devices in its two possible end positions (i.e., opened or extended and closed or collapsed). In the case of a blocking in the fully pushed-together state (i.e., when the drawer is closed), these devices include the at least one snap-in tooth, which engages in the opening of the carcass rail. In the fully pulled-out state (i.e., when the drawer is fully opened), a form-locking blocking is also achieved, on the one hand, by means of the at least snap-in projection of the notch lever which engages in a recess of the carcass rail and, thereby, blocks the center rail with respect to the carcass rail. In the fully pulled-out state, the form-locking blocking also is achieved as a result of the at least one snap-in tooth which, in the fully pulled-out state of the guiding rail, rests against the forward face edge of the center rail.

When the guiding rail is to be extended from its pushed-together state or is to be collapsed from its extended state, an operation of the rod with the at least one snap-in tooth is necessary in both cases. Operation of the rod with the at least one snap-in tooth moves the at least one snap-in tooth either out of the recess of the carcass rail or swivels the at least one snap-in tooth out of the face side area of the center rail. In either case, once the snap-in tooth has been disengaged from the corresponding locking structure, movement of the guiding rail becomes possible. After disengagement of the at least one snap-in tooth, for the longitudinal displacement of the guiding rail, in the pull-out direction as well as in the push-in direction, only the internal frictional forces have to be overcome, but no additional forces have to be applied for eliminating the blocking.

Additional characteristics of the invention will be appreciated by those skilled in the art from the description provided hereby and also by the claims appended hereto.

BRIEF DESCRIPTION OF THE DRAWINGS

Embodiment(s) of the invention is(are) illustrated in the attached drawings and will be described in detail in the following, in which.

DESCRIPTION OF EMBODIMENT(S) OF THE INVENTION

While the present disclosure describes embodiment(s) of the invention, the scope is intended to encompass variations and equivalents thereof, as would be appreciated by those skilled in the art.

Figure 1:
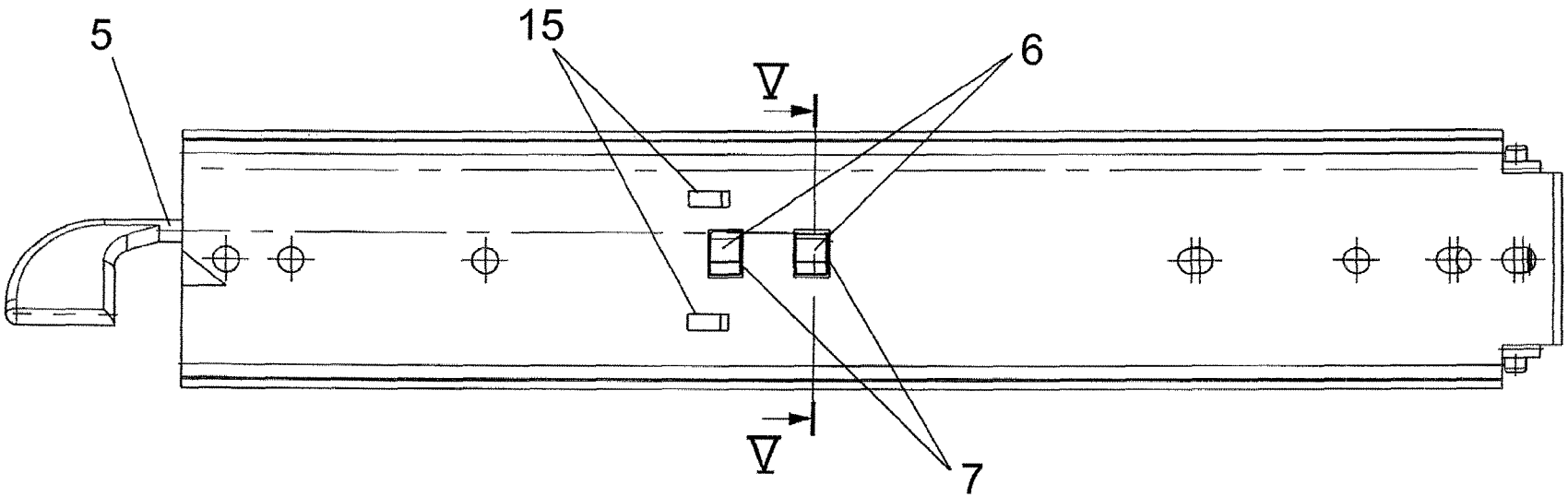
FIG. 1 is a rear view of a guiding rail according to the invention in the pushed-together state.
Figure 2:
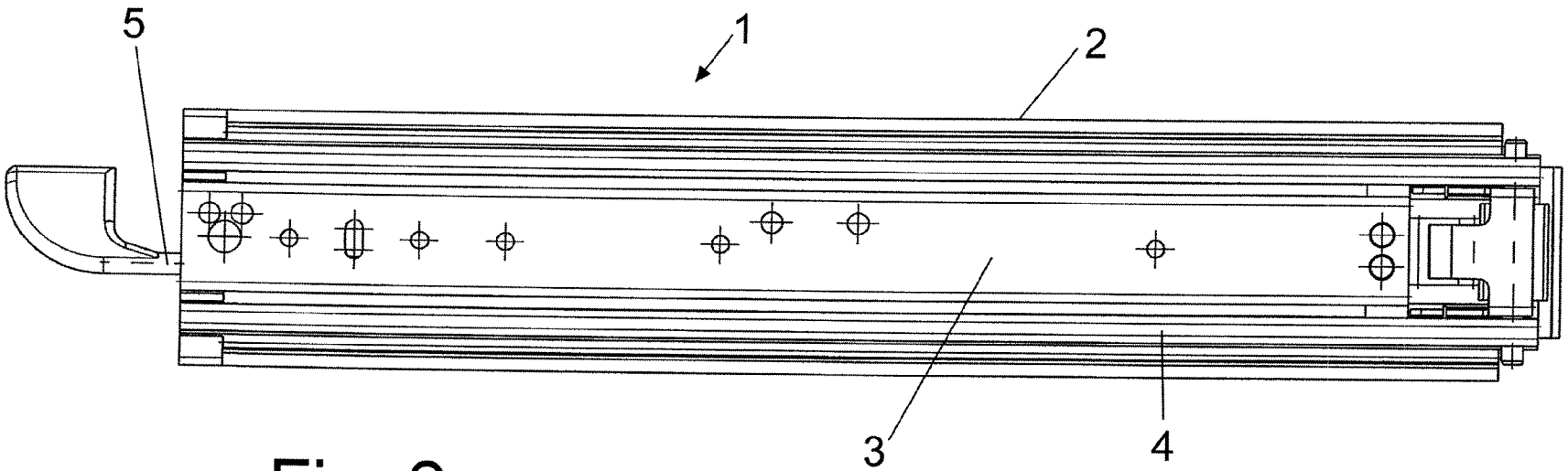
FIG. 2 is a front view of the face of the guiding rail according to FIG. 1.
Figure 3:
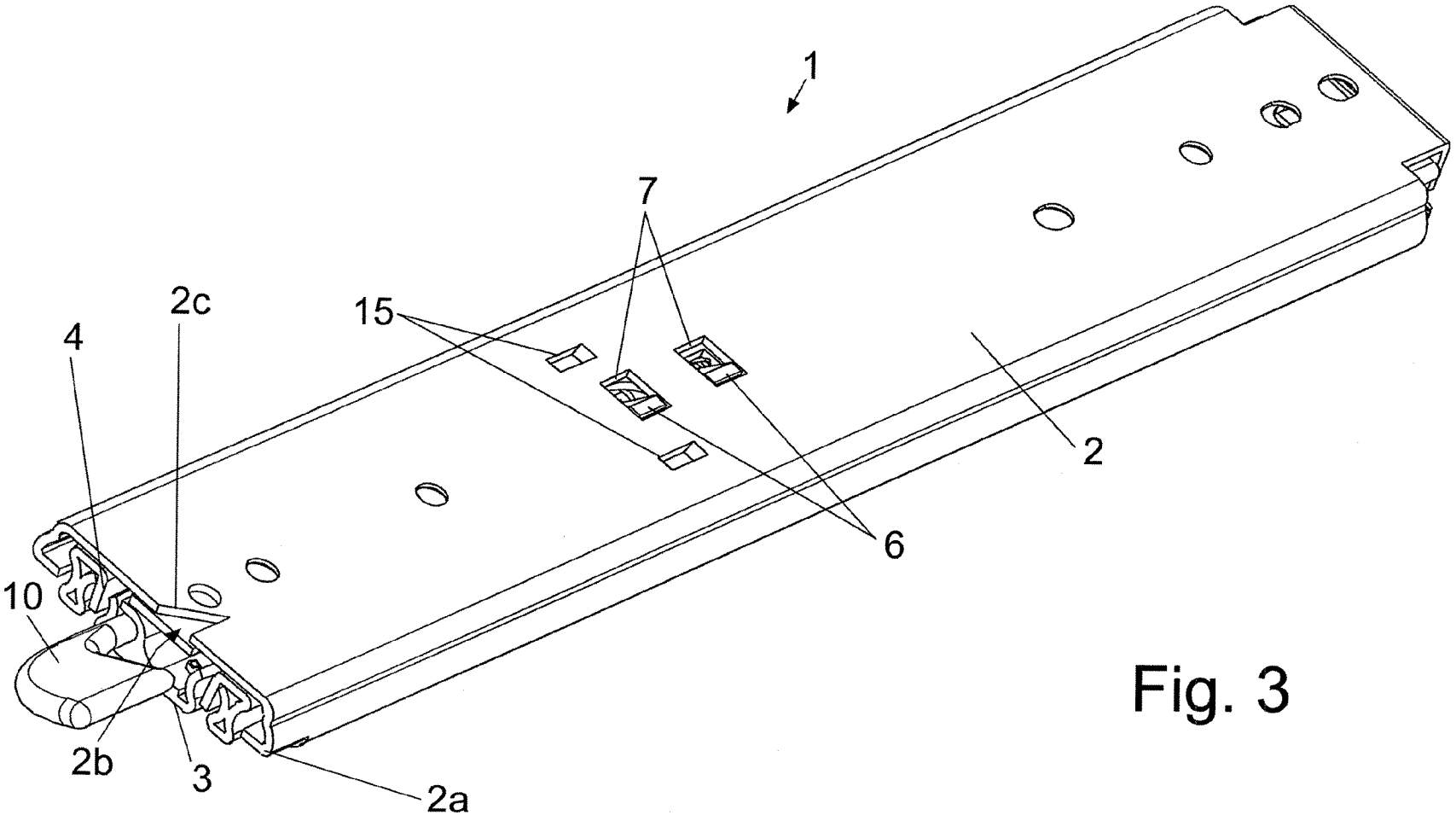
FIG. 3 is a perspective view of the rear of the guiding rail.
Figure 4:
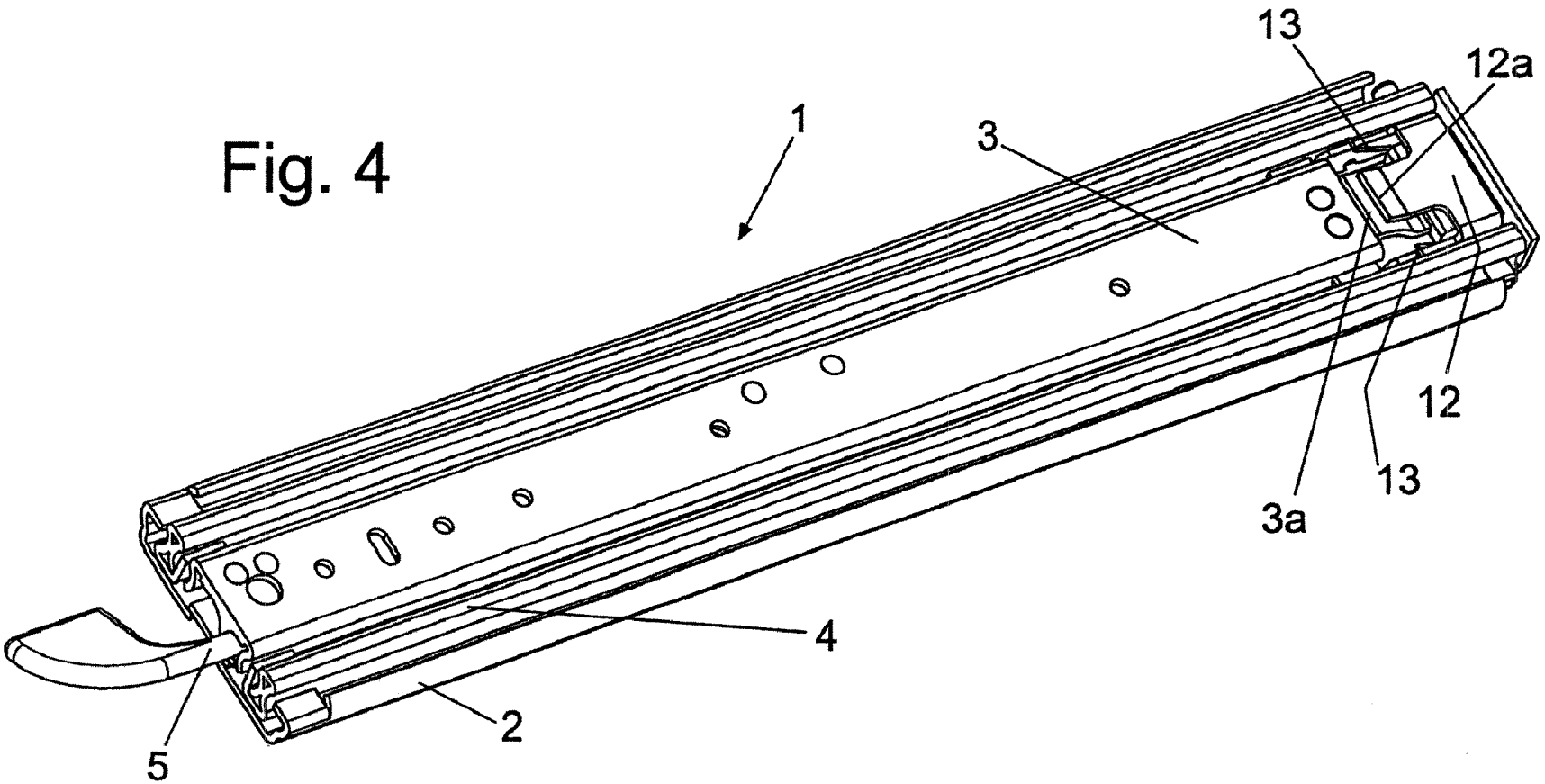
FIG. 4 is a perspective view of the face of the guiding rail.

In the drawings, reference number 1 indicates a guiding rail for a cabinet drawer part, which is not shown. The cabinet drawer part may be a drawer, shelf, or other structure suitable for supporting or containing one or more predetermined articles thereon or therein. As illustrated in FIG. 2, the guiding rail 1 includes a carcass rail 2 fixable to a cabinet carcass, a running rail 3 connectable with a drawer part, and a drawer-extending center rail 4 arranged between the carcass rail 2 and the running rail 3. The running rail 3 is telescopically slidable within the center rail 4, which is telescopically slidable within the carcass rail 2. This telescopic arrangement is illustrated, for example, in FIG. 6.

In the fully pushed-together condition, as shown in FIGS. 1 to 4, the guiding rail 1 is blocked. The term "blocked," as used herein is intended to refer to a condition where the guiding rail may not be extended or compressed by gravity or by an unintended action, such as bumping by an individual. This means that the running rail 3 and the center rail 4 cannot be displaced with respect to the carcass rail 2. This blocking is achieved by a rod 5 which is mounted in the running rail 3 and has two snap-in teeth 6 which engage in corresponding openings 7 in the carcass rail 2, as illustrated particularly in FIGS. 1, 3 and 5.

Figure 9:
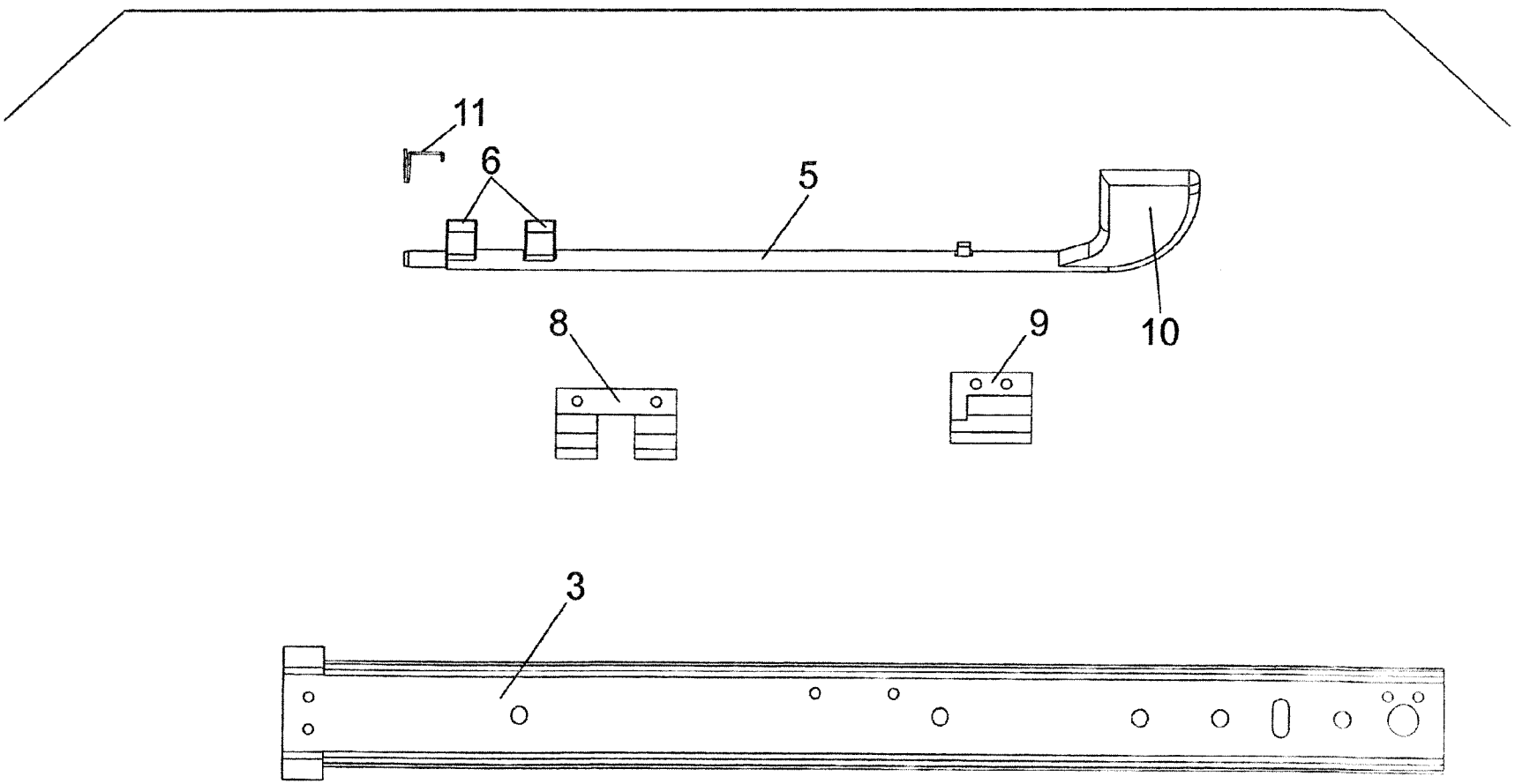
FIG. 9 is an exploded view of a running rail of the guiding rail according FIGS. 1 to 8 with a rod having snap-in teeth, which rod can be mounted in the running rail.

As illustrated particularly in FIG. 9, the rod 5 is rotatably disposed inside the running rail 3 by way of two bearing blocks 8 and 9, which can be screwed or otherwise fixed to the running rail 3. The rod 5 also is secured against an axial displacement by the two bearing blocks 8 and 9. At the end protruding beyond the forward end of the running rail 3, the rod 5 is equipped with a handle 10 extending at an angle with respect to the longitudinal axis of the rod 5.

Figure 5:
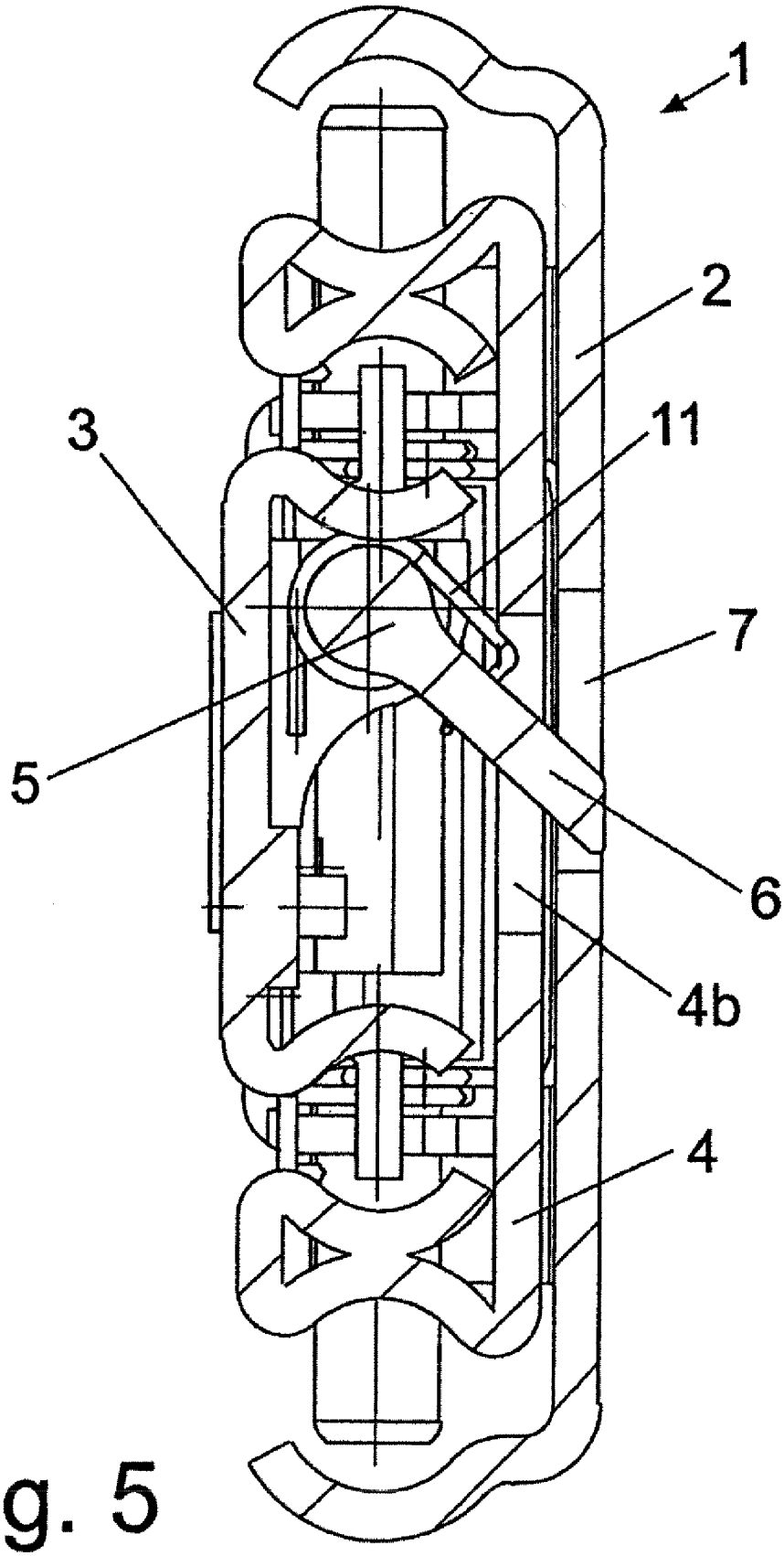
FIG. 5 is a cross-sectional view of the guiding rail taken at line V-V in FIG. 1.

By means of a spring 11 acting upon one of the snap-in teeth 6, as clearly illustrated in FIG. 5, the rod 5 is acted upon by a torque, by which the snap-in teeth 6 are constantly rotated in the direction of the carcass rail 2. This means that the snap-in teeth 6 snap into the above-mentioned openings 7 of the carcass rail 2 when the rod 5 is not operated by a user by way of the handle 10 against the loading direction of the spring 11. In other words, to disengage the snap-in teeth 6 from the carcass rail 2, a user must rotate the handle 10 to overcome the spring force applied by the spring 11.

When the snap-in teeth 6 engage the opening 7 in the carcass rail 2, the above-mentioned blocking of the guiding rail 1 is ensured, because the running rail 3 cannot be displaced with respect to the carcass rail 2 in its longitudinal direction. Only when a user swivels or rotates the rod 5, by gripping and rotating the handle 10 oppositely to the direction of the force applied by the spring 11, to a rotational point where the snap-in teeth 6 are swiveled out of the openings 7, can the running rail 3 be displaced with respect to the carcass rail 2 in the longitudinal direction or in the pull-out direction, for example.

Figure 6:
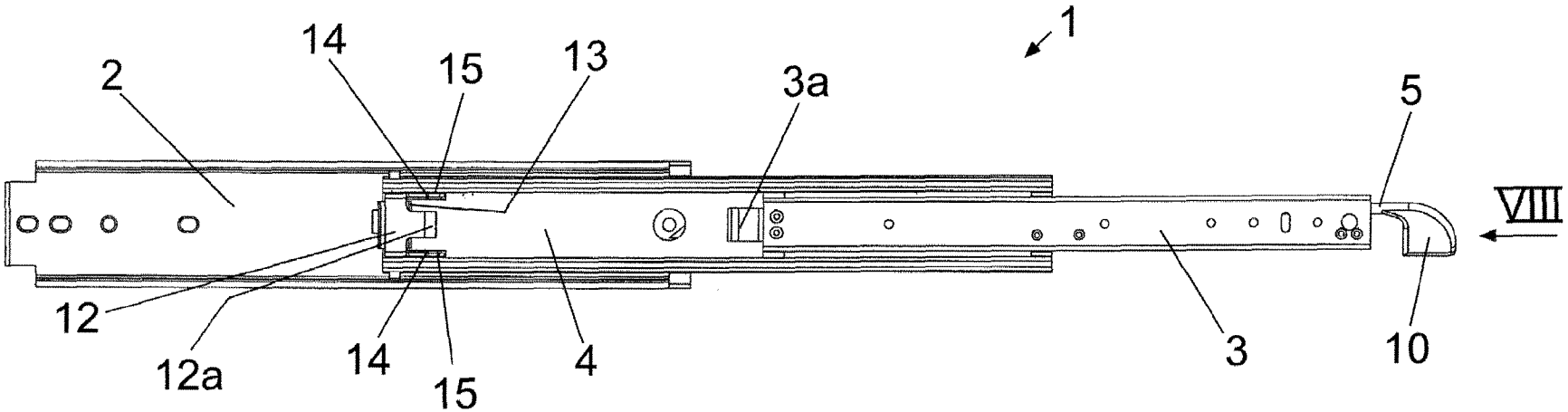
FIG. 6 is a front view of the face of the guiding rail according to the invention in a completely pulled out state.
Figure 7:
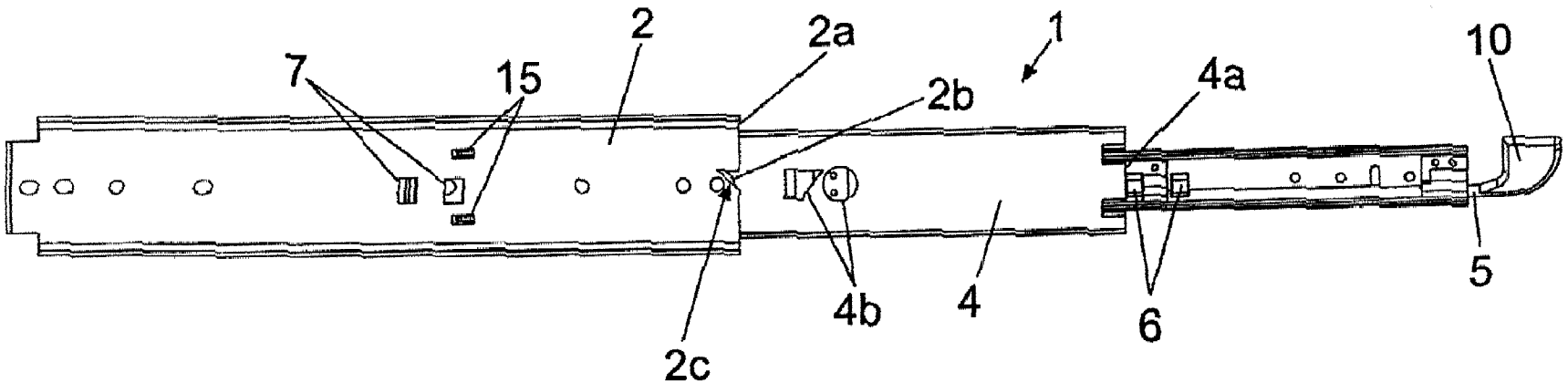
FIG. 7 is a rear view of the guiding rail, also in the completely pulled-out state.
Figure 8:
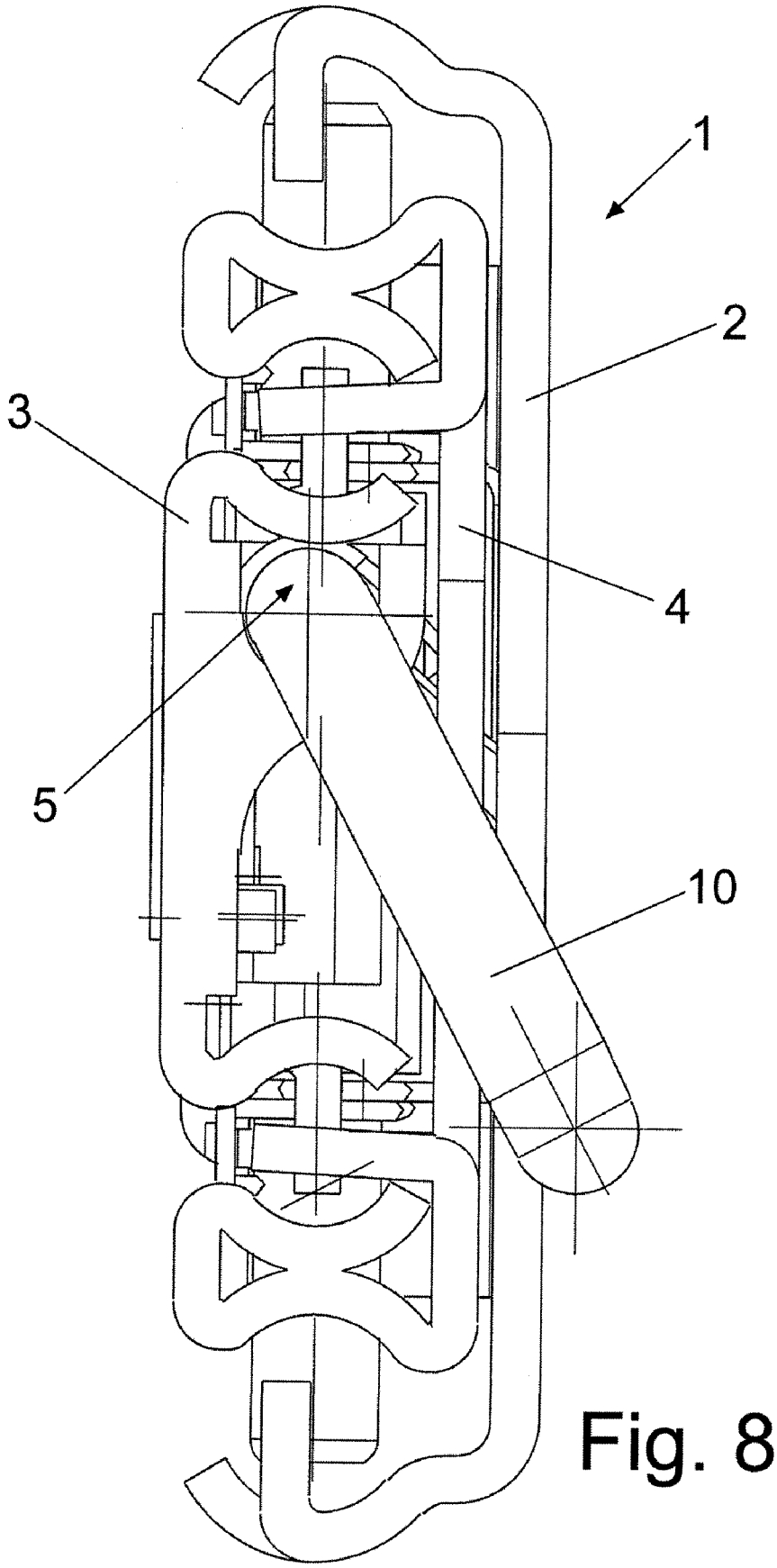
FIG. 8 is a end view of the guiding rail, the end view being taken from the direction of the arrow VIII in FIG. 6.

In the fully pulled-out condition of the guiding rail 1, as illustrated in FIGS. 6 and 7, when the rod 5 is not swiveled or rotated by a user, one of the snap-in teeth 6 is situated in front of the face-side forward end 4*a* of the center rail 4. This is clearly visible in FIG. 7.

FIG. 6 shows that, at the rearward end of the center rail 4, a notch lever 12 is swivelably disposed on the center rail 4 and is loaded by a spring 13 such that the snap-in projections 14 of the notch lever 12 are constantly loaded in the direction of the carcass rail 2. In the fully pulled-out condition, the snap-in projections 14 engage in recesses 15 of the carcass rail 2. By this operation, when the guiding rail 1 is completely pulled out, as illustrated in FIG. 6, the center rail 4 is mechanically blocked with respect to the carcass rail 2.

An operating lug 3*a* is fastened to the rearward end of the running rail 3. The operating lug 3*a*, when the guiding rail 1 is moved into the closing position, moves under an operating nose 12*a* of the notch lever 12 and moves this notch lever 12 out of the recesses 15 of the carcass rail 2 against the action of the spring 13. As a result, the center rail 4 is unlocked with respect to the carcass rail 2 and, with respect to this carcass rail 2, can be pushed back into its end position. In the fully pulled-out position of the guiding rail 1 illustrated in FIGS. 6 and 7, the center rail 4 is blocked with respect to the carcass rail 2 by means of the notch lever 12. In this condition, one of the snap-in teeth 6 is situated in front of the forward face edge 4*a* of the center rail 4. This means that, in this position, the running rail 3 also cannot be displaced in the closing direction with respect to the center rail 4, so that the entire system is blocked. A drawer part connected with the running rail 3 is thereby secured in the fully opened position against an unintended pushing-back.

To collapse the guiding rail 1 from the extended position, it is necessary to rotate the rod 5 by means of its handle 10 to such an extent that the snap-in tooth 6 is swiveled out of the contact area to the forward face edge 4*a* of the center rail 4. Then, the running rail 3 can be displaced in the closing direction with respect to the center rail 4. In this case, the center rail 4 is at first still blocked by the notch lever 12 with respect to the carcass rail 2. During the slide-in movement of the running rail 3, the operating lug 3*a* connected to the rearward end of the running rail 3 arrives in the contact area to the operating nose 12*a* of the notch lever 12 and lifts the latter, as described above, to such an extent that the locking of the center rail 4 with respect to the carcass rail 2 is eliminated and the guiding rail 1, as a whole, can be moved into its pushed-together condition.

The two snap-in teeth 6 have a distance from one another which differs from all distances between all mounting openings not indicated in detail within the center rail 4 and the carcass rail 2 in order to prevent that the snap-in teeth 6 swivel in an unintended manner into one of these openings.

In order to be able to engage in the openings 7 of the carcass rail 2, the snap-in teeth 6 have to be able to also pass through the center rail 4. For this purpose, corresponding openings 4*b* (see FIGS. 5 and 7) are provided within the center rail 4.

The construction illustrated also provides for the potential situation where, as a result of an unfortunate displacement movement in which the snap-in teeth 6 pass through the center rail 4 before they rest on the carcass rail 2, the drawer part may be pushed into a closed position without hindrance. To allow for this possible situation, a notch 2*b* with an inlet slope 2*c* at the forward face-side end 2*a* of the carcass rail is provided. The snap-in teeth 6 are automatically swiveled back into the area of the carcass rail 2 against the effect of the spring 11 loading the snap-in teeth 6 when the snap-in teeth engage the inlet slope 2*c* of the notch 2*b*.

The above-described construction simplifies removal of the blockages from the closed to the fully extended positions of the guiding rail 1. In addition, the above-described construction also discourages unintended collapse of the guiding rail 1 by an involuntary force applied to the end of the drawer when the guiding rail 1 is in the extended position.

The described construction provides for elimination of a blockage (or a blocked condition) without the need to apply forces more than required to push in or pull out the drawer part. All that is required to remove the blockage is to swivel the snap-in teeth 6 by the rotation of the rod 5, by way of its handle 10, out of its blocking position.

It is noted that the construction is such that unintentionally high loads upon the guiding rail 1 in the pull-out or slide-in direction cannot eliminate a blockage. As a result, the elimination of a blocking position by a user can be carried out very easily, but not by means of unintended manipulations or loads upon the guiding rail 1. In this context, it should be mentioned that a prevention of an unintended displacement movement of a corresponding guiding rail also increases safety.

What is claimed is:

1. A guiding rail for a cabinet pull-out part, comprising:

a carcass rail, fixable to a cabinet carcass;

a running rail, fixable to the cabinet pull-out part;

a center rail slidably connecting the carcass rail to the running rail, permitting telescopic movement of the carcass rail, the center rail, and the running rail with respect to one another from a compressed position to an extended position;

a blocking device comprising a rod extending longitudinally to the running rail, and being mounted within the running rail to be rotatable about a longitudinal axis, at least one first snap-in tooth projecting from the rod transversely to the longitudinal axis engageable with a first opening in the running rail, a notch lever pivotally disposed at a rearward end of the center rail, at least one second snap-in tooth associated with the notch lever, engageable with a second opening in the carcass rail, and a first spring biasing the at least one second snap-in tooth to engage the second opening in the carcass rail, wherein, when the guiding rail is fully extended, the at least one first snap-in tooth rests against a forward face of the center rail, the first spring acts on the notch lever such that the at least one second snap-in tooth is biased in the direction of the carcass rail, and the at least one second snap-in tooth engages with the second opening in the carcass rail, thereby establishing a blocking action; and an operating lug disposed in a rearward end of the running rail, wherein the operating lug acts upon the notch lever to release the at least one second snap-in tooth, thereby at least partially terminating the blocking action, wherein the guiding rail is lockable both in the extended position and the compressed.

2. The guiding rail according to claim 1, wherein the at least one first snap-in tooth comprises two ore more snap-in teeth disposed on the rod a first distance from one another that differs from a second distance of openings in at least one of the center rail and the carcass rail for mounting-related reasons.

3. The guiding rail according to claim 1, further comprising:

two bearing blocks connected to the running rail via one or more fasteners, wherein the rod is connected to the running rail via the two bearing blocks.

4. The guiding rail according to claim 1, further comprising:

a second spring operable with the rod, wherein the at least one first snap-in tooth is constantly loaded in the direction of the carcass rail by means of the second spring.

5. The guiding rail according to claim 1, further comprising:

a handle disposed on a forward end of the rod, wherein the handle is bent an angle with respect to the longitudinal axis of the rod.

6. The guiding rail according to claim 1, wherein, a forward end of the carcass rail defines a notch having an inlet slope that is situated in a displacement area of the at least one first snap-in tooth.

* * * * *